United States Patent [19]

Greyvenstein

[11] Patent Number: 5,041,317

[45] Date of Patent: Aug. 20, 1991

[54] PERFORATED MATERIAL

[76] Inventor: Lourence C. J. Greyvenstein, 150 Senior Drive, Northcliff, Johannesburg, South Africa

[21] Appl. No.: 350,910

[22] Filed: May 12, 1989

Related U.S. Application Data

[63] Continuation-in-part of Ser. No. 366,309, Jun. 13, 1989, Pat. No. 4,890,736.

[30] Foreign Application Priority Data

May 13, 1988 [ZA] South Africa ..... 88/3387

[51] Int. Cl.[5] ..... B65D 30/00

[52] U.S. Cl. ..... 428/35.5; 206/390; 383/37; 428/43; 428/906

[58] Field of Search ..... 428/35.2, 35.5, 43, 428/906; 383/37; 206/390

[56] References Cited

U.S. PATENT DOCUMENTS

| | | | |
|---|---|---|---|
| 3,762,542 | 10/1973 | Grimes | 383/37 |
| 3,851,760 | 12/1974 | Smith | 206/390 |
| 3,931,886 | 1/1976 | Yamauchi | 206/390 |
| 4,309,468 | 1/1982 | St. Aubin | 428/43 |
| 4,318,235 | 3/1982 | Augeri | 428/43 |
| 4,681,785 | 7/1987 | Horn | 428/43 |
| 4,890,736 | 1/1990 | Greyvenstein | 383/37 |

*Primary Examiner*—James J. Seidleck

*Attorney, Agent, or Firm*—Cushman, Darby & Cushman

[57] ABSTRACT

Continuous rolled material is described which is formed as lay flat tubing and which has lines of perforations running transversely to the axis of the material and dividing the material into discrete units. Alternate lines of perforations are sinusoidal lines. There are cuts in these lines of perforations at the mid-portions between the crests of the sinusoidal lines. The remaining perforations are arranged so that the transverse components of their lengths are substantially constant. Other kinds of perforated continuous material are also described.

18 Claims, 3 Drawing Sheets

Figure 2
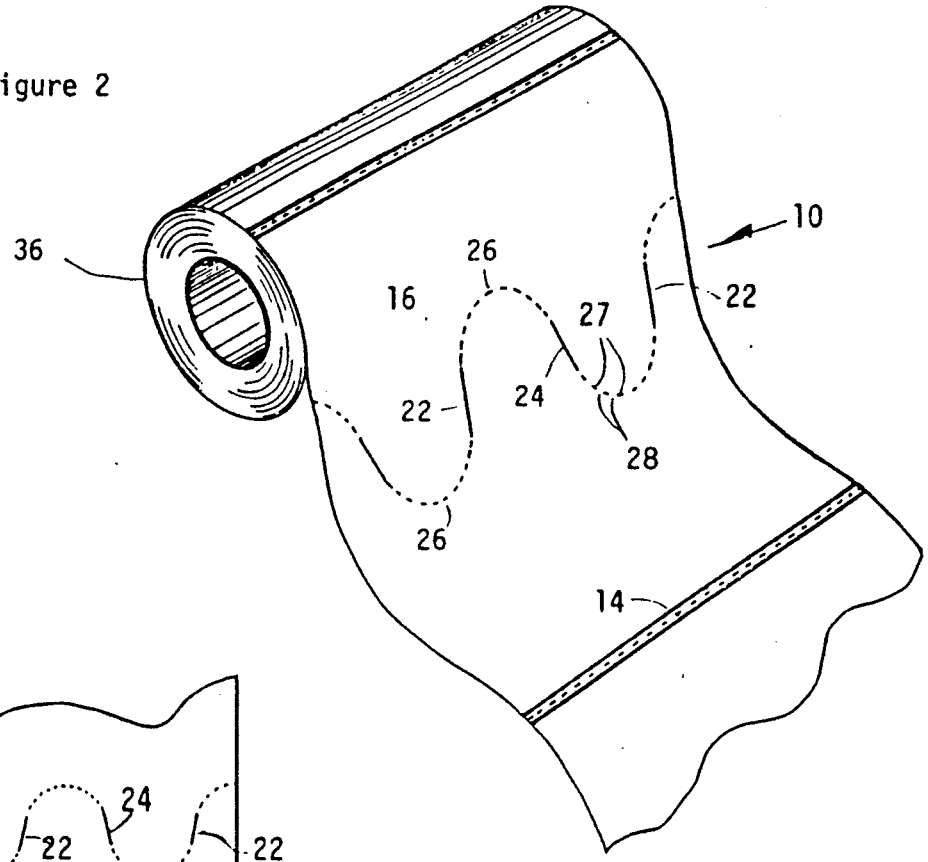
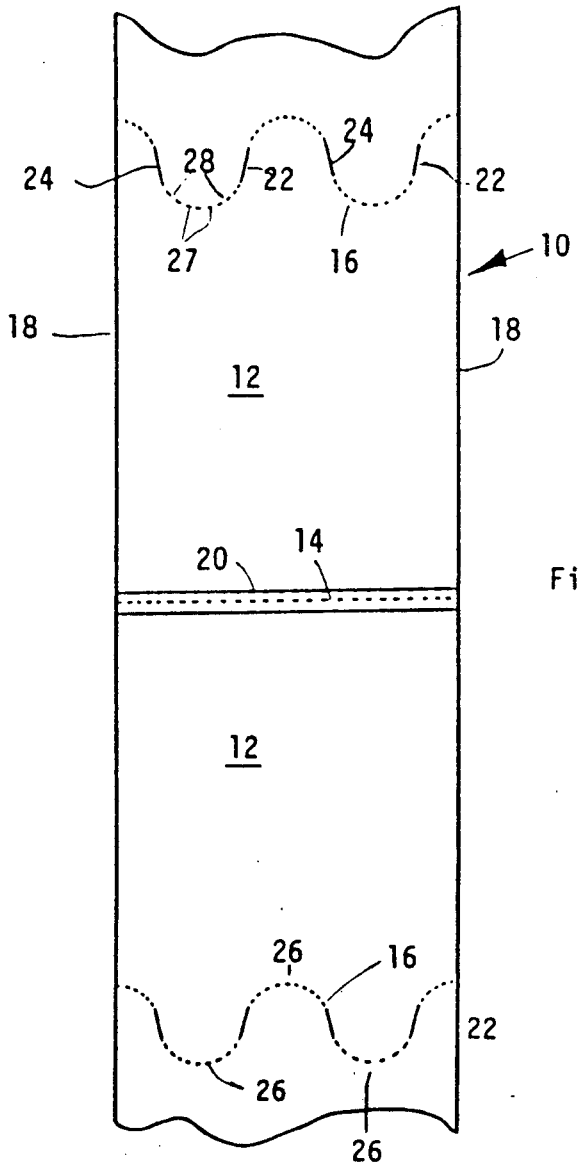
Figure 1

Figure 3
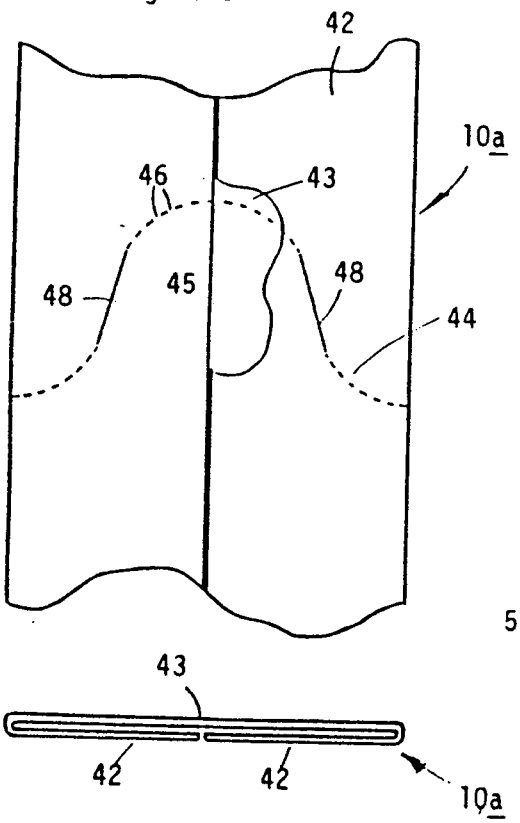
Figure 4
Figure 6
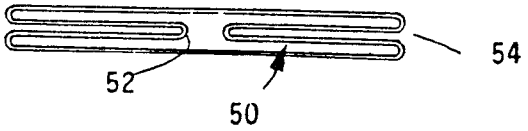
Figure 5
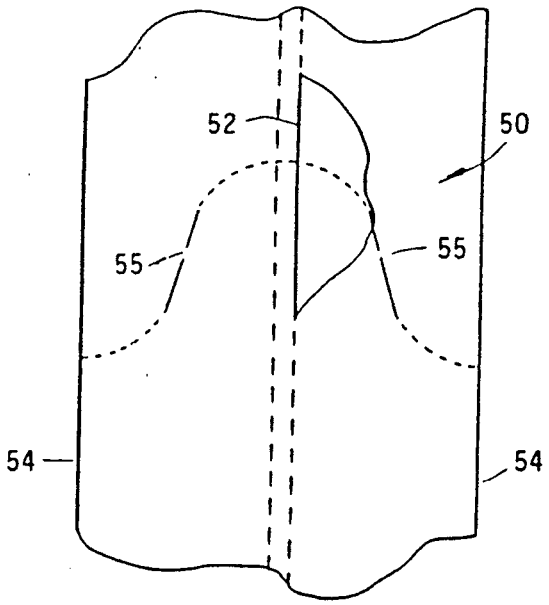
Figure 9
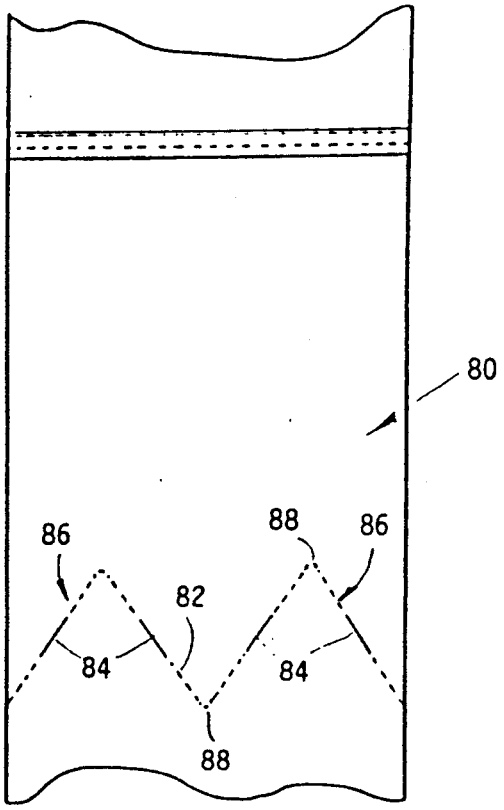

Figure 8
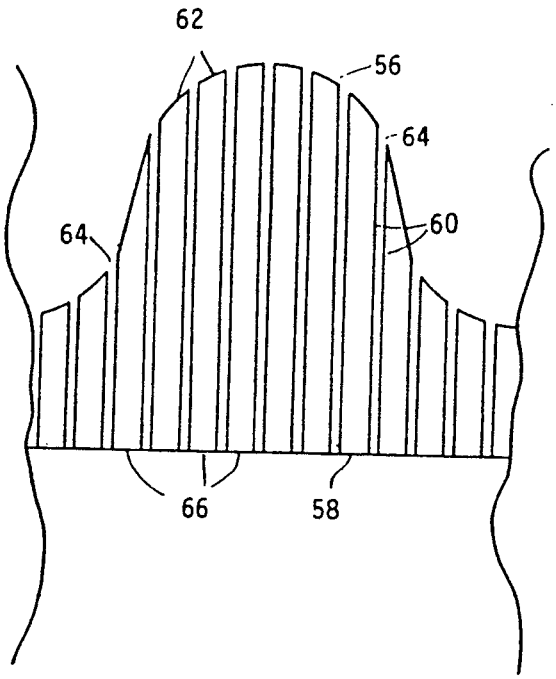
Figure 7
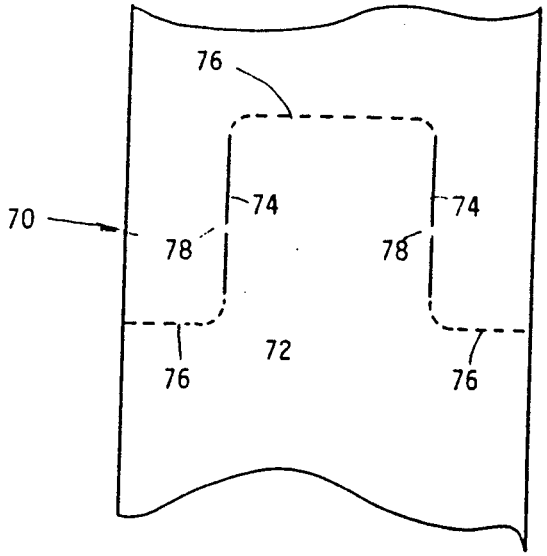
Figure 11
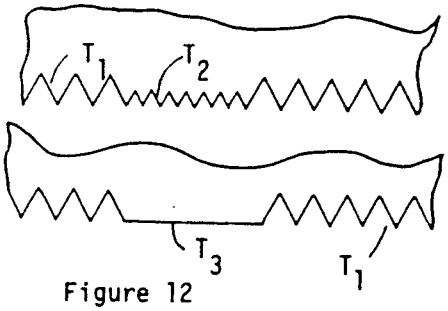
Figure 12
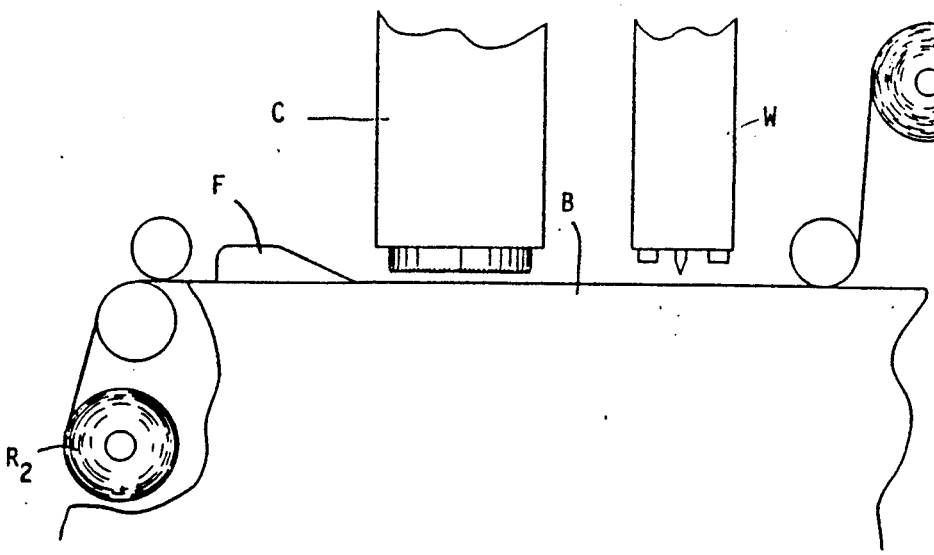
Figure 10

PERFORATED MATERIAL

This application is a continuation-in-part of my copending application No. 07/366,309, filed June 13, 1989, now U.S. Pat. No. 4,890,736.

This invention relates to continuous rolled material which has lines of perforations running transversely to the axis of the material and dividing the material into discrete units (which material is hereinafter called "continuous perforated material").

A line of perforations comprises small cuts (hereinafter referred to as "perforations") and material between the cuts (hereinafter called "connectors").

The invention is concerned with continuous perforated material in which at least some of the lines of perforations are "shaped" i.e. the lines of perforations have a shape other than a straight line running for its full length transversely of the axis of the material. Such material is hereinafter called "continuous shaped perforated material".

A typical continuous shaped perforated material is that described in the specification of my U.S. Pat. No. 4,890,736. In that specification there is described a length of material formed by units that when separated from the material in use constitute garbage bags, the material comprising an elongated length of plastic material which was formed as a tube and which is in lay flat condition, the tube being divided into pairs of units that are separated from each other by transverse welds and perforations and the units of each pair being separated by a sinusoidal line of perforations.

I have found that with such continuous shaped perforated material there is often difficulty in removing one of the units from the remainder of the material (which shall be hereinafter referred to as "the remainder") and often either the connectors do not tear or the material itself tears at places other than at the line of perforations.

According to one aspect of the present invention there is provided continuous shaped perforated material in which the perforations in at least part of a shaped line of perforations which extends at an incline to the axis of the material (and usually at a varying incline to the axis e.g. by the line of perforations being sinusoidal) wherein the perforations are of different lengths conveniently being arranged so that the transverse components of their lengths are substantially constant. Where the line of perforations is sinusoidal, all the perforations (except at the parts of the line about the midpoint of the wave form) may be of the same length as their transverse components will vary only slightly, i.e. these components will be substantially constant. In an arrangement as set forth above, the closer a part of the line of perforations extends to the direction of the axis, the longer will be the lengths of the perforations and indeed this part of the line is preferably comprised by an elongated cut. This arrangement (i.e. the provision of a continuous cut) is preferably also provided in the steeply inclined portions of the line where the length of material is folded over especially where the folded over portions may move out of register during packing or rolling or during the application of an axial force to remove the unit from the remainder.

Where the shaped line of perforations is in the form of a wave, preferably a sinusoidal wave, and conveniently where the material comprises a lay flat tube, the perforations are preferably arranged so that the portions of the line of perforations mid-way between the crests are comprised by continuous cuts.

There may be areas of the material where tearing other than at the connectors is more possible because of extra strain on the material. In such circumstances, the line of perforations in this area are weakened further, preferably by increasing the overall lengths of the perforations, to minimize the possibility of the unguided tearing of the material.

Where there is an elongated continuous cut, small tacking connectors may be provided to hold the material in a constant location.

According to another aspect of the invention there is provided continuous perforated material wherein there is a cut along a portion of each of the said shaped lines of perforations to facilitate the grasping of the material in a unit adjacent the roll. This cut may be one of the cuts referred to above as may be located in the center of the said shaped line. More than one cut may be provided in which case the cuts are preferably equispaced about the center of the said shaped line.

Embodiments of the invention will now be described by way of example with reference to the accompanying drawings.

In the drawings:

FIG. 1 is a plan view of a length of the continuous shaped perforated material laid flat, FIG. 2 is a perspective view of a roll of the continuous perforated material, FIG. 3 is a plan view partially broken away of a length of material in the laid flat condition which is wound into a roll folded in the longitudinal direction, FIG. 4 is a section through the material of FIG. 3, the dimensions being considerably distorted in the interests of clarity, FIG. 5 is view similar to FIG. 3 of the material in gussetted form, FIG. 6 is a view similar to FIG. 4 of the material of FIG. 5, FIG. 7 is a detail of a portion of the line of perforations in a length material of the invention, FIG. 8 is a detail of another length of material of the invention having perforations in a square wave form, FIG. 9 is a view similar to FIG. 8 of a length of material having perforations in a triangular wave form, FIG. 10 is a diagrammatic side view of the apparatus for perforating and folding the material of FIG. 3, FIG. 11 is a diagrammatic development of a detail of one form of the perforating teeth, and FIG. 12 is a similar view of another form of perforating teeth.

Referring to FIG. 1 there is shown a length of continuous shaped perforated material 10. This material comprises an extruded lay flat tube of plastics material. The tube is extruded in the direction of the axis of the material. The material is divided into discrete units 12 by two sets of lines of perforations 14 and 16.

Each line of perforations 14 extends in a straight line extending transversely to the axis of the material between the edges 18 of the material. Each line 14 is located between a pair of parallel end welds 20 which also extend transversely to the axis of the material and which define the closed ends of bags formed by the units 12 when they are separated from the remainder.

Each line of perforations 16 is a shaped line of perforations and extends in a sinusoidal wave form extending generally transversely to the axis of the material between the edges 18 of the material and midway between the line of perforations 14. Two elongated cuts 22 and 24 are provided along each sinusoidal line of perforations 16 being located on either side of the crests 26 of the wave forms closer to the remainder of the material. These cuts 22 and 24 are about one quarter of the length of one pitch of the line of perforations 16. There are perforations 27 and connectors 28 at the centers of the crests 26 of the wave form to hold these parts flat and firmly in position prior to the tearing of the connectors.

The tube in its lay flat condition as shown is seven hundred and twenty millemeters wide. The distance between the lines of perforations 14 is one meter seven hundred and twenty millemeters long. The amplitude of the sinusoidal lines of perforations 16 is one hundred and seventy millemeters and its pitch is three hundred and sixty millimeters. The plastics material is twenty one and a quarter micrometers thick. The perforations 27 at the substantially horizontal portions of the wave form are two and a half millemeters long and the connectors 28 at this location are about one and a quarter millemeters long. The length of each of the cuts 22 and 24 is about ninety millemeters.

In use, the material 10 is reasonably loosely wound on to a roll 36 (see FIG. 2) with one or more units 12 hanging down from the roll. When the two outermost units are connected by a shaped sinusoidal line of perforations 16 and a person wishes to remove a unit 12, he may insert his fingers through a pair of cuts 22 and 24 at a crest 26 and tear the connectors 28 and grasp the material of the outermost unit 12. On pulling this material, the outermost unit 12 will tear away from the remainder along the line of perforations 16. A corresponding action occurs when the outermost units are connected by a straight line of perforations 14, where the person pulls the material causing it to tear from the remainder along the line of perforations 14.

Alternatively, the person wishing to remove the unit will grasp all the material in his hands and will crush it together. On pulling the material down sharply, the connectors will tear and the material will part along the line of perforations.

By providing the cuts as set forth above, the shaped lines of perforations 16 can be relatively firm while still permitting relatively easy tearing along the said lines 16.

Referring now to FIGS. 3 and 4, there is shown a detail of a length of continuous shaped perforated material 10*a* formed from material 10 as described above. In this material 10*a*, the side parts 42 (of a quarter of the material width) are folded over the central portion 43 to reduce the width of the material when wound on to a roll to about three hundred and sixty to three hundred and seventy milleters which is about the largest convenient size in use. The sinusoidal waveform line 44 of perforations is located in such a position that the portions thereof in the side parts 42 will overlie and register with the adjacent portions in the central portion 43.

It will be seen that the perforations 42 are arranged so that at the edges 44 of the folded over layers there are perforations 45 and connectors 46. Elongated cuts 48 are provided in the lines of perforations midway between the crests and where the lines of perforations approach the direction of the axis of the material. Here again the user may insert his fingers through the cuts 48 to grasp the material therebetween and to pull the material downwardly. Alternatively the entire tube may be grasped in the hands of the user. When he pulls down sharply, the connectors will tear and the material will part along the line of perforations 46. It will be noted that when the material is grasped, the various layers of material (there being four in all) will move transversely to one another and will be out of register. For this reason, I have found that the cuts 48 are particularly desirable in the lines of perforations.

The tubular material 10*a* is made using apparatus indicated diagrammatically at FIG. 10. The material in layflat condition is wound on to a first roll $R_1$. From here it is fed on to a bench B and stopped periodically. A welder cutter W is brought down on to the stationary material to form the line of perforations 14 and welds 20. A cutter C comprising a blade formed into the shape of a sinusoidal wave at the same time cuts the line of perforations 16. The material is now passed through a folder F so that the side portions 42 are folded over the central portions 43 into the form as shown in FIG. 3 and the material is now rolled on to a roll $R_2$ for storage and subsequent usage. The manufacture of the roll 36 of material is similar save that the folder F is omitted.

The developed shape of the cutter C is shown in FIG. 11. The teeth $T_1$ are relatively widely spaced apart to cut the perforations. The teeth $T_2$ are closely spaced and as these pass through the material, they form a continuous cut. In the embodiment of FIG. 12, a single cutter $T_3$ replaces the teeth $T_2$ to make the continuous cuts. The length of the set of teeth $T_2$ and the cutter teeth $T_3$ is such that the continuous cuts which they make are of substantially greater length than the perforation cuts.

Reference is now made to FIGS. 5 and 6, wherein is shown a detail of a lay flat tube 50 formed initially in the same way as the tube of FIG. 1 but then has portions 52 folded inwards so that the units 12 to be formed are gussetted. Here the lines of perforations are in sinusoidal wave form with cuts located away from the four edges 54 of the tube.

Small "tacking" connectors 55 may be provided in the cuts to hold the material on both sides thereof together.

In FIG. 7 there is shown a part of a shaped, wave form, sinusoidal line 56 of perforations. Also shown is a line 58 extending at right angles to the axis of the material and longitudinal lines 60. The lines 58 and 60 are notional lines to illustrate the following description. As the line 56 is of sinusoidal wave form, the various perforations 62 are inclined to the transverse notional line 58. The connectors 64 are all very short and of the same length. The lengths of the perforations 62 are different but the transverse component (indicated by the notional divisions 66 on transverse line 58 defined by lines 60) are the same for all the perforations. In this Figure, the cuts are not shown. These of course will be longer than the perforations. However these cuts are not essential with this arrangement.

With this arrangement of the perforations 62 there will be an even distribution of strain in the material of the connectors and consequently, I have found, the material tends to tear evenly at the connectors along the line of perforations and not elsewhere. The same technique can be used to determine the perforations for any other shaped line of perforations other than that described.

Referring to FIG. 8, there is shown a length of continuous shaped perforated material 70 wherein the shaped line of perforations 72 is of a square wave form having longitudinal sections 74 extending in the direction of the axis of the material between the crests formed by transverse sections 76 lying normal to the axis. These longitudinal sections 74 are constituted by cuts while the transverse sections 76 are constituted by perforations. A few small tacking connectors 78 are provided at the cuts 74. A line of perforations of this kind, I have found, permits the material to tear easily and conveniently.

Referring now to FIG. 9 there is shown a length of continuous shaped perforated material 80 wherein the shaped line of perforations 82 is of a triangular wave form. Cuts 84 are provided midway along each straight line 86 between the crests 88. I have found that a line of perforations of this kind also permits the material to tear easily and conveniently.

It will be appreciated that the range of lengths of the perforations and connectors (and indeed the cuts) will depend upon many factors. These include the strength and density as well as the elasticity of the material and whether the material is flat or gussetted. If the perforations are not merely straight cuts, this too will affect the lengths chosen for them.

I have found that units 12 separated by lines of perforations as described above can be separated from the remainder easily and cleanly, with the continuous shaped perforated material not tearing other than along the lines of perforations.

The invention is not limited to the precise constructional details hereinbefore described and illustrated in the drawings. For example all the shaped lines of perforations may be of the same shape or one or more may be of different shapes which need not be sinusoidal. The lengths of the cuts may vary. The folds may be different to those illustrated and may cover different amounts of material. The tacking connectors may be provided in the cuts 22, 24 and 48 of the FIGS. 1 and 3 embodiments. The lines of perforations may be replaced by elongated cuts with sets of connectors (and perforations) at various critical locations e.g. at the edges of the material, at the crests or at any other place where the lack of connectors would result in the material not being held firm and flat. The sizes of the tubes may vary. The continuous material need not be formed by extruding a tube, it may be flat sheet material. Nor need the material be a plastics material and may comprise e.g. paper or other non-woven fabric. The shaped line of perforations may be of other wave forms.

The material may be folded on itself in any manner as desired and in particular may be folded along its longitudinal axis.

I claim:

1. A roll of extruded continuous lay flat tubing material having longitudinal sides and transverse lines of perforations, wherein each line of perforations is in the form of a wave, and wherein portions of each line of perforations midway between crests and valleys of the respective wave are comprised by continuous cuts of substantially greater length than the perforations.

2. Material as claimed in claim 1 wherein there are provided small tacking connectors at the continuous cut to hold the material in a constant location.

3. Material as claimed in claim 1 wherein the wave is a sinusoidal wave.

4. Material as claimed in claim 1 wherein the sides of the tube are folded over to reduce the width of the tube.

5. Material as claimed in claim 1 wherein the tube is internally gussetted.

6. Material as claimed in claim 5 wherein each said portion of the line of perforations comprised by a continuous cut is of a length of about one quarter of the pitch of the waves.

7. Material as claimed in claim 5 wherein each said line of perforations extends from one side of the material to the other said side thereof.

8. Material as claimed in claim 5 wherein each said line of perforations extends from one side of the material to the other said side thereof.

9. Material as claimed in claim 5 wherein the perforation lines joining the crests and valleys of the waves extend in the direction of extrusion of the material and are comprised of said continuous cuts.

10. Material as in claim 5 wherein at least a portion of each line of perforations extends at an incline to the direction of extrusion of the material.

11. Material as in claim 24 wherein perforations are of different length.

12. Material as in claim 24 wherein transverse components of the lengths of the perforations are substantially constant.

13. A length of extruded continuous lay flat tube material with a central portion and sides folded over the central portion to reduce the width of the tube and a plurality of lines of perforations extending transversely to the direction of extrusion of the material, wherein at least part of each line of perforations extends at an incline to said direction of extrusion of the material, wherein the perforations in the sides substantially register with perforations in the central portion and wherein the perforations are arranged so that the portions of the lines extending substantially parallel to said direction of extrusion of the material are comprised by continuous cuts of substantially greater length than the perforations.

14. A length of extended continuous lay flat tube material with a central portion and sides folded over the central portion to reduce the width of the tube and a plurality of lines of perforations extending transversely to the direction of extrusion of the material, in which each said line of perforations is in the form of a sinusoidal wave and the perforations in the sides substantially register with the perforations in the central portion and wherein the perforations are arranged so that the portions of the line of perforations mid-way between the crests and valleys are comprised by continuous cuts of substantially greater length than the perforations.

15. Material as claimed in claim 12 wherein each said portion of the line of perforations comprised by a continuous cut is of a length of about one quarter of the pitch of the sinusoidal waves.

16. Continuous rolled extruded lay flat material which has longitudinal sides and lines of perforations running transversely to the direction of extrusion of the material from one said side to the other and dividing the material into discrete units in which at least part of a line of perforations extends at an incline to the direction of extrusion of the material and include a portion extending in a direction nearly parallel to said direction of extrusion, wherein the transverse components of the lengths of the perforations are substantially constant and wherein said portion of each line of perforations is comprised by an elongated cut of substantially greater length than the perforations.

17. A length of extruded continuous rolled material which has longitudinal sides and sinusoidal lines of perforations running transversely to the direction of extrusion of the material, from one side of the material to the other side, each said line having at least one crest and one valley, said lines of perforations dividing the material into discrete units wherein that the center portion of each part of each said sinusoidal lines of perforations which extends between a crest and a valley is comprised by an elongated cut of substantially greater length than the perforations.

18. Material as claimed in claim 14 wherein each said portion of the line of perforations comprised by a continuous cut is of a length of about one quarter of the pitch of the sine waves.

* * * * *

UNITED STATES PATENT AND TRADEMARK OFFICE

CERTIFICATE OF CORRECTION

PATENT NO. : 5,041,317

DATED : August 20, 1991

INVENTOR(S) : GREYVENSTEIN, Lourence C. J.

It is certified that error appears in the above-identified patent and that said Letters Patent is hereby corrected as shown below:

Title page: "18 Claims, 3 Drawing Sheets" should read --17 Claims, 3 Drawing Sheets--

Col. 6, claim 1, line 1, change "claim 5" to --claim 1--

Claim 7, line 1, change "claim 5" to -- claim 1 --.

Claim 8, cancel in its entirety (a duplicate of Claim 7).

Claim 9, line 1, change "claim 5" to -- claim 1 --.

Claim 10, line 1, change "claim 5" to -- claim 1 --.

Claim 11, line 1, change "claim 24" to -- claim 10 --.

Claim 12, line 1, change "claim 24" to -- claim 10 --.

Claim 15, line 1, change "claim 12" to -- claim 14 --.

Claim 16, col. 6, line 65, change "include" to -- includes --.

Col. 8, claim 18, line 1, change "claim 14" to --claim 17--

Signed and Sealed this

Sixteenth Day of November, 1993

*Attest:*

Bruce Lehman

BRUCE LEHMAN

*Attesting Officer*

*Commissioner of Patents and Trademarks*